US007562952B2

(12) United States Patent
Yamamoto

(10) Patent No.: US 7,562,952 B2
(45) Date of Patent: Jul. 21, 2009

(54) RESIDUAL INK AMOUNT DETECTION MODULE FOR INK JET RECORDING, INK TANK WITH THE MODULE, AND INK JET RECORDING DEVICE

(75) Inventor: Hajime Yamamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 324 days.

(21) Appl. No.: 11/593,550

(22) Filed: Nov. 7, 2006

(65) Prior Publication Data

US 2007/0052741 A1 Mar. 8, 2007

Related U.S. Application Data

(63) Continuation of application No. PCT/JP2005/009422, filed on May 24, 2005.

(30) Foreign Application Priority Data

Jun. 3, 2004 (JP) ..... 2004-165888

(51) Int. Cl.
*B41J 2/195* (2006.01)

(52) U.S. Cl. ..... 347/7; 347/5; 347/86

(58) Field of Classification Search ..... 347/5, 347/7, 9, 12, 86
See application file for complete search history.

(56) References Cited

U.S. PATENT DOCUMENTS

| | | | | |
|---|---|---|---|---|
| 6,137,503 | A | 10/2000 | Hashimoto et al. | 347/19 |
| 6,325,500 | B1 | 12/2001 | Kitabatake et al. | 347/86 |
| 6,422,674 | B1 | 7/2002 | Hinami et al. | 347/7 |
| 6,530,654 | B2 | 3/2003 | Kitabatake et al. | 347/86 |
| 6,869,158 | B2 | 3/2005 | Kojima et al. | 347/19 |
| 6,935,716 | B2 | 8/2005 | Hatasa et al. | 347/19 |

(Continued)

FOREIGN PATENT DOCUMENTS

| | | |
|---|---|---|
| EP | 779156 | 6/1997 |

(Continued)

OTHER PUBLICATIONS

European Search Report dated Jan. 9, 2008, from corresponding European Application No. 05743319.5.

(Continued)

*Primary Examiner*—Lam S Nguyen
(74) *Attorney, Agent, or Firm*—Fitzpatrick, Cella, Harper & Scinto

(57) ABSTRACT

An ink remaining amount detecting module (20) has a support substrate (21), an information storage element (22) provided on a first surface (21*b*) of the substrate (21), and external contact electrodes (24) provided on a second surface (21*c*) of the substrate (21). Two through-holes (21*a*) are formed in the substrate (21) so as to penetrate the substrate (21) from the first surface (21*b*) to the second surface (21*c*). A sealing structure (23) is provided on the first surface (21*b*) of the substrate (21) so as to cover the information storage element (22) and through-holes (21*a*). The sealing structure (23) is formed of a light transmissive member and is shaped like a prism. The ink remaining amount detecting module (20) is mounted on a cup portion (2) constituting a part of a housing of an ink tank so that the sealing structure (23) is exposed to an ink accommodating chamber (6).

12 Claims, 9 Drawing Sheets

U.S. PATENT DOCUMENTS

| | | | | |
|---|---|---|---|---|
| 6,994,431 | B2 | 2/2006 | Kitabatake et al. | 347/86 |
| 7,029,107 | B2 | 4/2006 | Kitabatake et al. | 347/86 |
| 7,055,926 | B2 | 6/2006 | Kojima et al. | 347/19 |
| 7,111,919 | B2 | 9/2006 | Hatasa et al. | 347/19 |
| 7,213,914 | B2 | 5/2007 | Anma et al. | 347/86 |
| 2003/0025743 | A1 * | 2/2003 | Maeda | 347/7 |
| 2005/0012766 | A1 * | 1/2005 | Fukano et al. | 347/7 |
| 2005/0151811 | A1 | 7/2005 | Shimizu et al. | 347/86 |
| 2005/0270315 | A1 | 12/2005 | Yamamoto | 347/7 |
| 2005/0270347 | A1 | 12/2005 | Yamamoto | 347/86 |
| 2007/0052774 | A1 | 3/2007 | Shimizu et al. | 347/86 |
| 2007/0159505 | A1 | 7/2007 | Yamamoto | 347/7 |

FOREIGN PATENT DOCUMENTS

| | | |
|---|---|---|
| EP | 860284 | 8/1998 |
| EP | 1382449 | 1/2004 |
| JP | 7-164626 | 6/1995 |
| JP | 2003-260804 | 9/2003 |

OTHER PUBLICATIONS

Chinese Office Action dated Jun. 6, 2008, from corresponding Chinese Application No. 2005800178677, and English language translation thereof.

* cited by examiner

RESIDUAL INK AMOUNT DETECTION MODULE FOR INK JET RECORDING, INK TANK WITH THE MODULE, AND INK JET RECORDING DEVICE

This application is a continuation application of PCT application No. PCT/JP2005/009422 under 37 Code of Federal Regulations § 1.53 (b) and the said PCT application claims the benefit of Japanese Patent Application No. 2004-165888, filed Jun. 3, 2004, which is hereby incorporated by reference herein in its entirety.

TECHNICAL FIELD

The present invention relates to an ink remaining amount detecting module used to detect the amount of ink remaining in an ink tank accommodating ink to be supplied to an ink jet print head for ink jet printing, an ink tank comprising the ink remaining amount detecting module, and an ink jet printing apparatus.

BACKGROUND ART

At least a print head and an ink tank are used for ink jet printing. The print heat ejects ink and the ink tank accommodates ink to be supplied to the print head. The ink is consumable. Accordingly, an ink jet printing apparatus is configured so that the ink tank can be detachably installed in the ink jet printing apparatus, independently or in a cartridge form integrated with the print head, to replace the ink tank with a new one when the ink in the ink tank is exhausted.

For conventional ink jet printing apparatuses, techniques have been proposed and put to practical use, the techniques which detect the presence or absence of ink in the ink tank in order to show a user when to replace the ink tank. The methods described below are used to sense the presence or absence of the ink.

(1) In one method, it is detected that the ink has reached a predetermined level (the level of the ink), using that a pair of electrodes is provided in the ink tank and a current flows between the electrodes via the ink.

(2) In another method, it is detected that the ink has reached the predetermined level, using that a prism having a refractive index similar to that of the ink is provided on an inner wall surface of the ink tank and the refraction of light varies depending on whether the level of the ink is higher or lower than the position of the prism when light is incident on the prism (3) In furthermore another method, it is detected that the ink has reached the predetermined level, using a variation in the capacitance between the ink in the ink tank and an electrode provided outside the ink tank. These methods may be combined with one another or with a method called dot count which converts the number of ink ejections or the like into the amount of ink used.

With reference to FIGS. 10A to 10C, description will be given of an example of a conventional detecting system that optically detects the ink remaining amount and that is included in the above described methods.

FIG. 10A shows a sectional view of a conventional ink tank 101 comprising means for optically detecting the ink remaining amount. Further, FIG. 10B shows a perspective view of a cup portion 102 of the ink tank 101.

The ink tank 101 has a cup portion 102 and a cover portion 103. Ink is housed in a housing 104 composed of the cup portion 102 and the cover portion 103. The interior of the housing 104 is divided into two spaces by a partitioning wall

114 having a communication channel 109 at the lower end and being formed in the cup portion 102. One of the spaces is an ink accommodating chamber 106 closed except for the communication channel 109 to directly accommodate ink. The other space is a negative pressure generating member housing chamber 105 that houses a negative pressure generating member 111 that absorbs and holds the ink. An ink supply port 110 and an air-through hole 108 are formed in a wall forming the negative pressure generating member housing chamber 105. The ink supply port 110 is used to supply the ink to a print head portion (not shown) and the air-through hole 108 is used to introduce external air into the ink tank 101 as the ink is consumed. In FIG. 10A, the shaded portion shows an area in which a negative pressure generating member 111 holds the ink.

A gas introduction groove 119 extending upward from the communication channel 109 is formed in a wall surface of the partitioning wall 114 which faces the negative pressure generating member housing chamber 105. The gas introduction groove 119 facilitates the introduction of the air from the negative pressure generating member housing chamber 105 into the ink accommodating chamber 106. Further, inside the negative pressure generating member housing chamber 105, the negative pressure generating member 111 is not present in a space (buffer portion) around the air-through hole 108.

The ink in the negative pressure generating member 111 is consumed by the print head portion and thereby a gas-liquid interface 111*a* in the negative pressure generating member housing chamber 105 is decreased down to the upper end of the gas introduction groove 119 shown in FIG. 10A. The subsequent ink consumption causes air to be introduced into the negative pressure generating member housing chamber 105 through the air-through hole 108. The introduced air enters the ink accommodating chamber 106 through the communication channel 109. Instead, the ink in the ink accommodating chamber 106 enters the negative pressure generating member housing chamber 105 through the communication channel 109. The ink is then filled into the negative pressure generating member 111. This operation is called a gas-liquid exchanging operation.

Accordingly, even when the ink in the negative pressure generating member housing chamber 105 is consumed by the print head portion, the negative pressure generating member 111 is filled with an amount of ink from the ink accommodating chamber 106 which corresponds to the consumed ink. The gas-liquid interface 111*a* in the negative pressure generating member housing chamber 105 is thus maintained at an almost fixed height. That is, the negative pressure generating member 111 holds an almost fixed amount of ink to maintain an almost fixed negative pressure on the print head portion. Consequently, the print head portion is stably supplied with ink.

A triangular-prism-shaped optical reflector 113 is placed on a bottom surface of the ink accommodating chamber 106. The optical reflector 113 is integrated with the cup portion 102 and its vertex has an angle of 90°. On the other hand, in the ink jet printing apparatus in which the ink tank 101 is installed, an optical sensor module 151 is placed below the optical reflector 113 as shown in FIG. 10C. The optical sensor module 151 has a light emitting portion 152 and a light receiving portion 153.

If there is no ink in the ink accommodating chamber 106, light emitted by the light emitting portion 152 enters the optical reflector 113 and is reflected by two slopes of the optical reflector 113 to return to the light receiving portion 153 as shown by the solid arrow in FIG. 10C. If ink is present at a position higher than that at which the light enters the slope of the optical reflector 113, light emitted by the light emitting portion 152 enters the optical reflector 113 and most of the light is then transmitted through the optical reflector 113 as shown by a dashed arrow. Consequently, the presence or absence of ink can be detected on the basis of the intensity of light returning to the light receiving portion 153.

Patent Document 1 (Patent Document 2) also discloses the configuration of an ink tank having an optical ink remaining amount detecting means as described above.

In recent years, many full-color ink jet printing apparatus have been developed which tend to use an increasingly large number of ink colors. Thus, more and more types of ink tanks have been mounted in the ink jet printing apparatuses. Some ink tanks are provided with inherent information in order to prevent erroneous installation. Known methods for proving the ink tank with inherent information include providing the ink tank with a mechanical ID (identifier) structure, bonding a bar code label to the ink tank, or providing the ink tank with an information storage element such as a ROM.

As described above, the conventional ink jet printing apparatuses use an increasingly large number of colors in order to meet the need for high-grade printing. Correspondingly, more and more types of ink tanks are mounted in the conventional ink jet printing apparatuses. On the other hand, there has been a growing demand for downsizing in order to minimize installation area or to improve portability for mobile use. Downsizing the ink jet printing apparatus requires downsizing the ink tank and simplifying the structure of the ink remaining amount detecting means.

Further, information on the detected ink remaining amount is conventionally transmitted to the ink jet printing apparatus, which then warns the user to exchange the ink tank. As previously described, some ink tanks have inherent information. However, such information relates to, for example, the type of ink accommodated and is required to prevent erroneous installation.

However, there have been no techniques which can detect information on ink using a simple structure and which can simply and reliably store the detected information in the ink tank.

Patent Document 1: Japanese Patent Application Laid-open No. 7-164626

Patent Document 2: U.S. Pat. No. 6,137,503

DISCLOSURE OF THE INVENTION

It is an object of the present invention to make it possible to detect information on ink accommodated in an ink tank using such a simple configuration as is applicable to a small-sized ink tank and to simply and reliably store the detected information. To accomplish this object, an ink remaining amount detecting module according to the present invention is mounted in an ink tank used for ink jet printing in order to detect the amount of ink remaining in the ink tank. The ink remaining amount detecting module comprises a support substrate having a site which transmits light, a nonvolatile information storage means provided on the support substrate and to and from which information can be written and read, a sealing structure provided on the support substrate so as to cover the information storage means and the site transmitting light, the sealing structure transmitting light and being shaped like a prism, and information transmitting means provided on the support substrate to receive external information on the ink remaining amount, write the information to the information storage means, and transmit the information written to the information storage means to an external device. In the ink remaining amount detecting module according to the present invention, the site of the support substrate transmitting light may be a plurality of through-holes penetrating the support substrate. In the ink remaining amount detecting module according to the present invention, the support substrate itself may be composed of a light transmissive member. In the ink remaining amount detecting module according to the present invention, the information transmitting means may be external contact electrodes provided on a surface of the support substrate which is different from that on which the information storage means and the sealing structure are provided, the external contact electrodes being electrically connected to the information storage means. In the ink remaining amount detecting module according to the present invention, the information transmitting means may have an antenna portion provided on a surface of the support substrate which is different from that on which the information storage means and the sealing structure are provided, the antenna portion utilizing high-frequency electromagnetic induction or a high-frequency electric wave to transmit and receive information in a non-contact manner. In the ink remaining amount detecting module according to the present invention, a reflector reflecting light may be formed on a part of the support substrate.

According to the ink remaining amount detecting module according to the present invention, the information storage means and the information transmitting means are provided on the support substrate. Further, the sealing structure, at least partly shaped like a prism, provides sealing so that the information storage means does not come into direct contact with ink or gas. Thus, the ink remaining amount detecting module has a function for optically detecting the ink remaining amount. This serves to provide a compact ink remaining amount detecting module with a simple configuration which is suitably mounted in a small-sized ink tank. The ink remaining amount detecting module according to the present invention also has the nonvolatile information storage means. Accordingly, information on the ink remaining amount can be simply and reliably stored in the ink remaining amount detecting module itself. An ink tank according to the present invention has an ink accommodating chamber in which ink is accommodated, and an ink supply port through which the ink in the ink accommodating chamber is supplied to a print head. The ink tank according to the present invention comprises an ink remaining amount detecting module including a support substrate having a site which transmits light, nonvolatile information storage means provided on the support substrate and to and from which information can be written and read, a sealing structure provided on the support substrate so as to cover the information storage means and the site transmitting light, the sealing structure transmitting light and being shaped like a prism, and information transmitting means provided on the support substrate to receive external information on the ink remaining amount, write the information to the information storage means, and transmit the information written to the information storage means to an external device. The ink tank according to the present invention further has a housing member constituting an outer wall of the ink accommodating chamber and the ink supply port. In the ink tank according to the present invention, it is characterized that the ink remaining amount detecting module is mounted in the housing member so that the sealing structure provided on the support substrate is exposed to the ink accommodating chamber and that another surface on the support substrate is exposed to an outer surface of the housing member. In the ink tank according to the present invention, the ink may be accommodated so that the ink contacts the sealing structure and that the ink having contacted the sealing structure reaches the ink supply port. In the ink tank according to the present invention, an opening may be formed in the housing member, and the ink remaining amount detecting module may be fixedly fitted into the opening in the housing member.

The above ink remaining amount detecting module according to the present invention is mounted in the ink tank according to the present invention. This makes it possible to detect the ink remaining amount and to provide the ink tank with information on the ink remaining amount, without hindering the ink tank from downsizing.

An ink jet printing apparatus, in which the above-mentioned ink tank according to the present invention is detachably installed, prints a print medium using a print head which ejects ink fed from the ink tank. The ink jet printing apparatus according to the present invention comprises a holding portion which detachably holds the ink tank, an optical sensor which emits light to the ink remaining amount detecting module of the ink tank held in the holding portion, and information transmitting means of a main body of the apparatus for transmitting and receiving information to and from the ink remaining amount detecting module via the information transmitting means of the ink remaining amount detecting module mounted in the ink tank. In the ink jet printing apparatus according to the present invention, a reflector reflecting light is formed on a part of the support substrate of the ink remaining amount module, and the optical sensor may be configured to move, relative to the ink tank, between a first position at which light emitted by the optical sensor is reflected by the reflector and a second position at which the light is incident on the sealing structure of the ink remaining amount detecting module.

The above ink tank according to the present invention is mounted in the ink jet printing apparatus according to the present invention. The ink jet printing apparatus according to the present invention also has the information transmitting means of the apparatus for transmitting and receiving information to and from the ink remaining amount detecting module mounted in the ink tank. The ink jet printing apparatus can thus control its own operations on the basis of information obtained utilizing the ink remaining amount detecting module. The ink tank can be provided with information on the amount of ink remaining in the ink tank. A method for manufacturing an ink tank according to the present invention comprises a step of providing a housing member constituting an outer wall of an ink accommodating chamber and the ink supply port and mounting a sealing structure of an ink remaining amount detecting module so as to be exposed to the ink accommodating chamber, the ink remaining amount detecting module comprising a support substrate having a site which transmits light, nonvolatile information storage means provided on the support substrate and to and from which information can be written and read, a sealing structure provided on the support substrate so as to cover the information storage means and the site transmitting light, the sealing structure transmitting light and being shaped like a prism, and information transmitting means provided on the support substrate to receive external information on the ink remaining amount, write the information to the information storage means, and transmit the information written to the information storage means, to an external device; a step of filling ink into the ink accommodating chamber; and a step of writing information indicating presence of ink to the information storage means of the ink remaining amount detecting module. In the method for manufacturing an ink tank according to the present invention, the step of filling ink into the ink accommodating chamber includes filling the ink so that the ink contacts at least the sealing structure and that the ink having contacted the sealing structure reaches the ink supply port. In the method for manufacturing an ink tank according to the present invention, information indicating absence of ink is pre-written to the information storage means, and the step of writing information indicating the presence of ink to the information storage means includes updating the information pre-written to the information storage means. The method for manufacturing an ink tank according to the present invention further comprises a step of writing information on a color of the ink to the information storage means of the ink remaining amount detecting module. In the method for manufacturing an ink tank according to the present invention, the information on the color of the ink is pre-written to the information storage means of the ink remaining amount detecting module, and the step of filling ink into the ink accommodating chamber includes filling ink of the same color as that indicated in the information on the color of the ink pre-written to the information storage means. In the method for manufacturing an ink tank according to the present invention, the information on the color of the ink is pre-written to the information storage means of the ink remaining amount detecting module, and the step of filling ink into the ink accommodating chamber includes filling ink of a color different from that indicated in the information on the color of the ink pre-written to the information storage means, and it further comprises a step of updating the information on the color of the ink pre-written to the information storage means. The method for manufacturing an ink tank according to the present invention further comprises a step of washing the interior of the ink accommodating chamber before the step of filling ink into the ink accommodating chamber.

With the method for manufacturing an ink tank according to the present invention, the information indicating the presence of ink is written to the information storage means of the ink remaining amount detecting module after ink has been filled. Accordingly, information on the amount of ink remaining in the ink tank is simply and reliably stored in the ink tank. This also avoids the inconsistency between information detected by the ink remaining amount detecting module and information held in the information storage means, the inconsistency possibly occurring if the used ink tank is utilized after it has been filled with ink.

According to the present invention, in the ink remaining amount detecting module, the information storage element and the information transmitting means are provided on the support substrate, and the sealing structure sealing the information storage element has, at least partly, a prism function for detecting the ink remaining amount. This makes it possible to detect the amount of ink remaining in the ink tank using a compact and simple configuration and to simply and reliably provide the ink tank with information on the ink remaining amount.

Further, with the method for manufacturing an ink tank according to the present invention, the amount of ink remaining in the ink tank can be determined using only the ink tank without the need to install the ink tank in the ink jet printing apparatus. Furthermore, if the ink tank is to be reused, it is possible to eliminate the inconsistency between the information detected by the ink remaining amount detecting module and the information held in the information storage means.

Further features of the present invention will become apparent from the following description of exemplary embodiments (with reference to the attached drawings).

BRIEF DESCRIPTION OF THE DRAWINGS

FIGS. 5A and 5B are diagrams illustrating how the ink remaining amount detecting module according to the embodiment shown in FIG. 1 detects the ink remaining amount, wherein FIG. 5A shows that enough ink is present in an ink accommodating chamber and FIG. 5B shows that there is no ink in the ink accommodating chamber;

FIGS. 6A and 6B are diagrams showing another embodiment of an ink remaining amount detecting module and an ink jet printing apparatus according to the present invention, wherein FIG. 6A shows the electrical configuration of the non-contact ink remaining amount detecting module and FIG. 6B shows the electrical configuration of an information storage element of the module shown in FIG. 6A;

FIGS. 7A to 7C are sectional views showing yet another embodiments of the structure of the ink remaining amount detecting module according to the present invention, wherein FIG. 7A shows an embodiment in which the support substrate of the ink remaining amount detecting module is composed of a light transmitting material, FIG. 7B shows an embodiment of the ink remaining amount detecting module shown in FIG. 7A in which a light blocking mask is formed on the support substrate, and FIG. 7C shows an embodiment in which the ink remaining amount detecting module is of the non-contact type;

FIGS. 10A to 10C are diagrams illustrating an example of a conventional detecting system that optically detects the ink remaining amount, wherein FIG. 10A is a schematic sectional view of a conventional ink tank, FIG. 10B is a perspective view of a cup portion of the ink tank, and FIG. 10C is a partly enlarged view illustrating an ink remaining amount detecting system.

BEST MODE FOR CARRYING OUT THE INVENTION

Now, embodiments of the present invention will be described with reference to the drawings.

Figure 1:
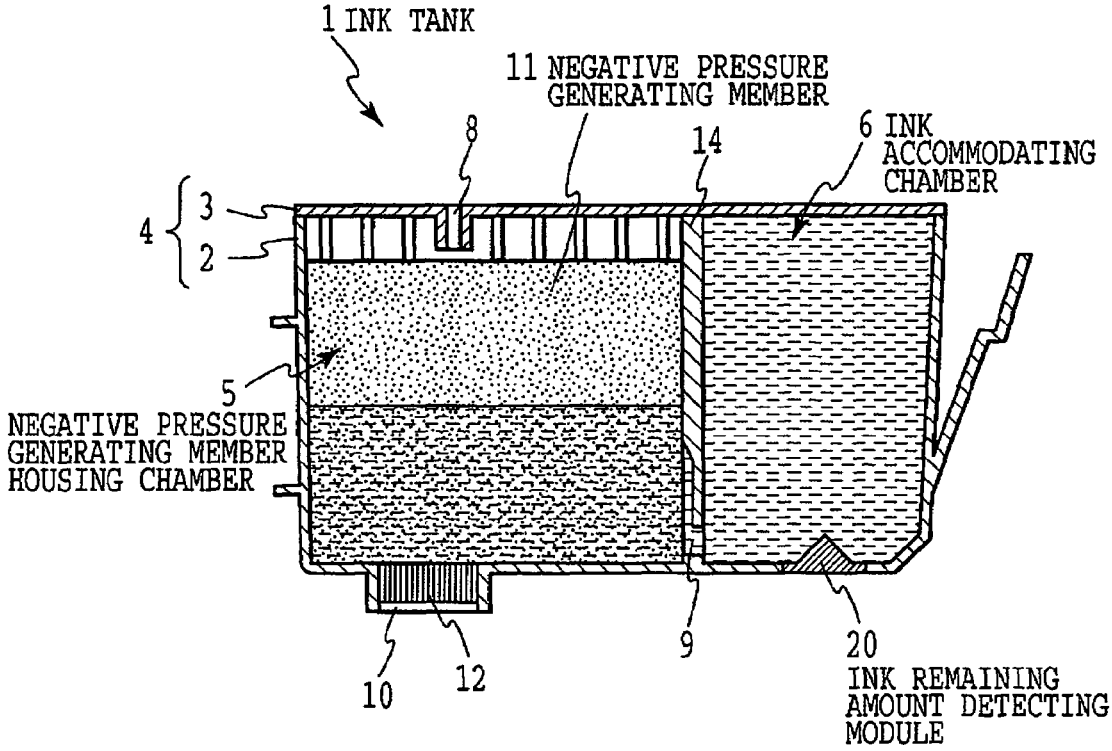
FIG. 1 is a sectional view of an ink tank according to an embodiment of the present invention.
Figure 10A:
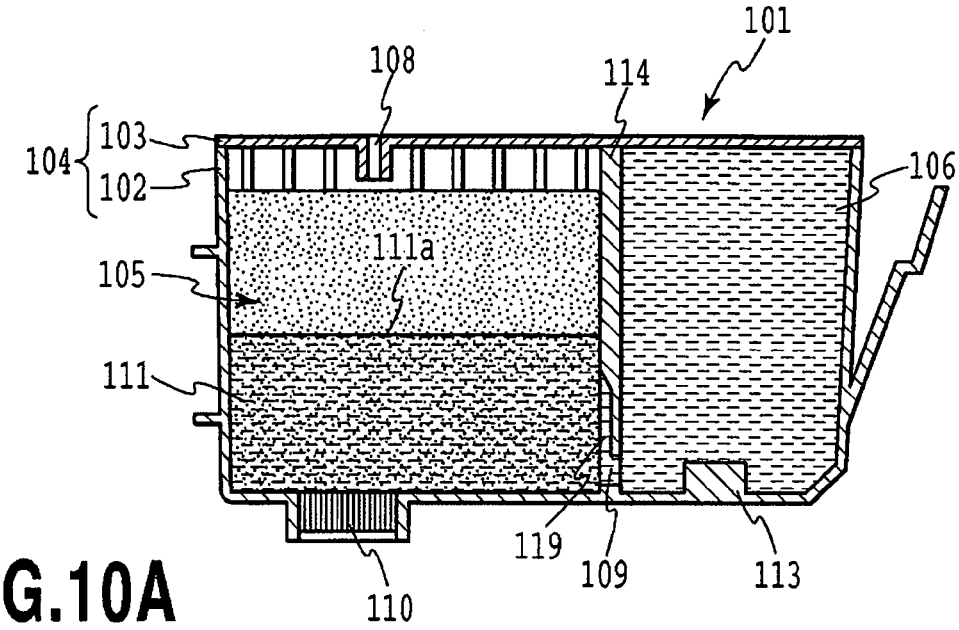
Figure 10B:
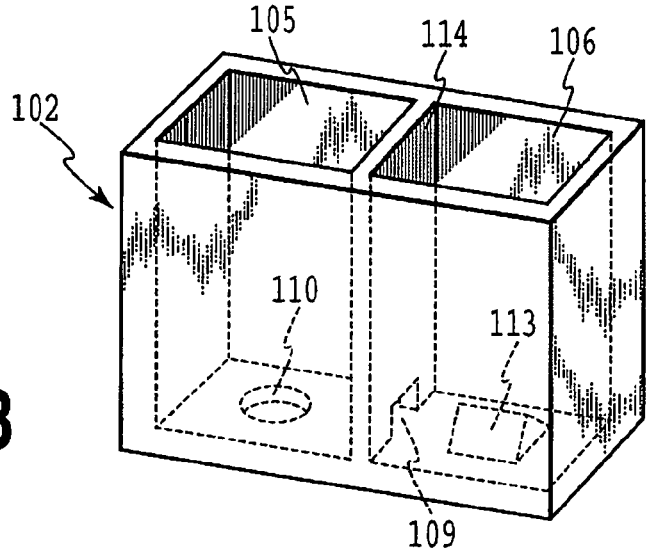
Figure 10C:
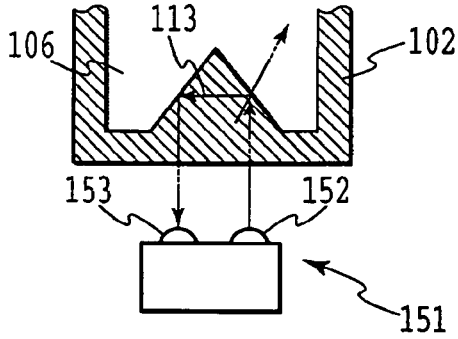

FIG. 1 is a sectional view of an ink tank according to an embodiment of the present invention. An ink tank 1 according to the present embodiment has a basic structure similar to that the ink tank 101, shown in FIGS. 10A to 10C. That is, a housing 4 is composed of a cup portion 2 and a cover portion 3. The interior of the housing 4 is partitioned into the following two chambers by a partitioning wall 14 having a communication channel 9 at the lower end and formed in the cup portion 2: an ink accommodating chamber 6 in which ink is to be directly accommodated or has already been accommodated and a negative pressure generating member housing chamber 5 in which a negative pressure generating member 11 that absorbs and holds the ink is accommodated. An ink supply port 10 and an air-through hole 8 are formed in a wall surface forming the negative pressure generating member housing chamber 5. The air-through hole 8 is formed in the cover portion 3 with the ink supply port 10 formed in a bottom wall of the cup portion 2 so that when the ink tank 1 is in a use position, the air-through hole 8 is located at the top of the ink tank, while the ink supply port 10 is located at the bottom. An ink lead-out member 12 is formed between the negative pressure generating member 11 and the ink supply port 10 to allow the ink absorbingly held in the negative pressure generating member 11 to be easily led to the ink supply port 10.

An ink remaining amount detecting module 20 is provided on a bottom wall of the cup portion 2 in an area forming the ink accommodating chamber 6. The module 20 detects information on the amount of ink remaining in the ink accommodating chamber 6. A structure associated with the ink remaining amount detecting module 20 is different from that in the ink tank 101, shown in FIGS. 10A to 10C. The ink remaining amount detecting module 20 will be described below in detail.

Figure 2:
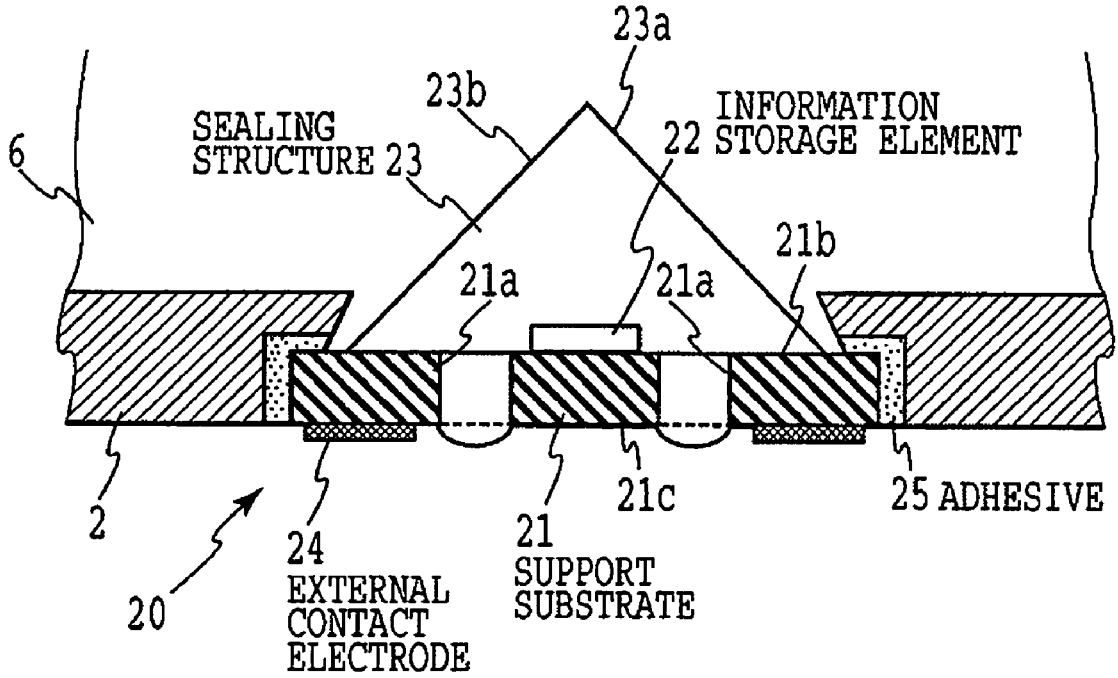
FIG. 2 is a sectional view of the neighborhood of an ink remaining amount detecting module of the ink tank according to the embodiment shown in FIG. 1.
Figure 3A:
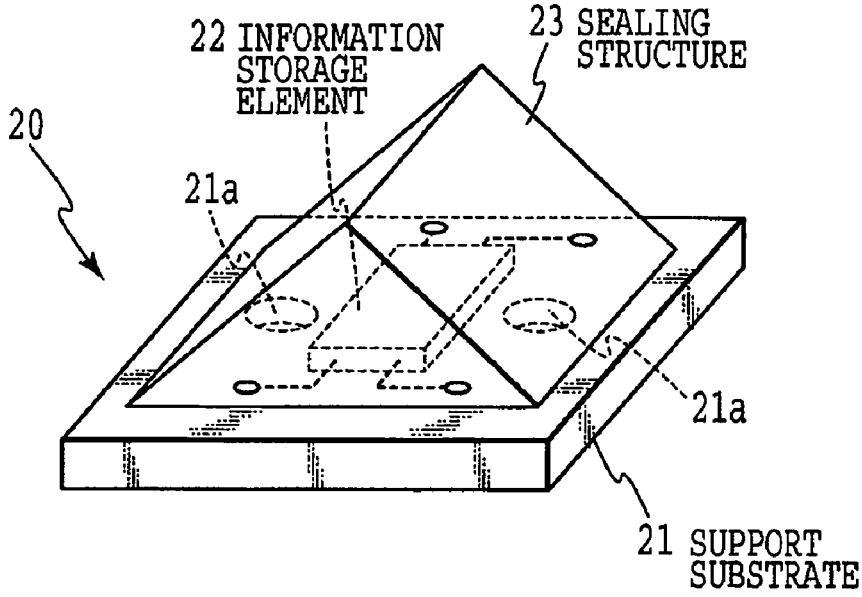
FIGS. 3A and 3B are perspective views of the ink remaining amount detecting module shown in FIG. 2, as viewed from a sealing structure and support substrate, respectively.
Figure 3B:
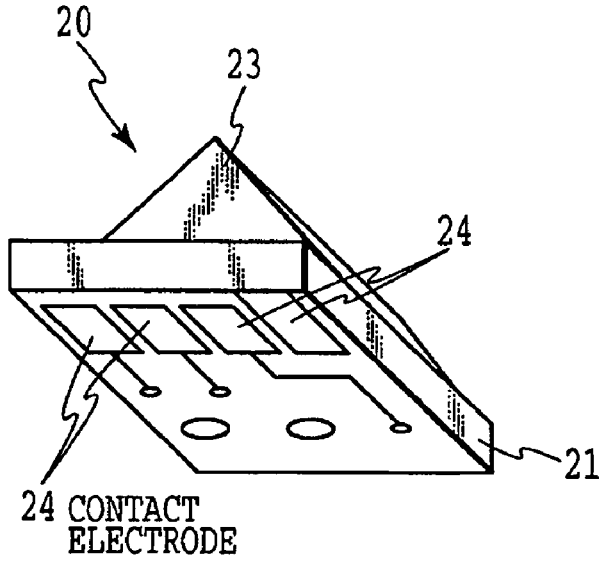

FIG. 2 is a sectional view of the neighborhood of an ink remaining amount detecting module of the ink tank according to the present embodiment. FIGS. 3A and 3B are perspective views of the ink remaining amount detecting module shown in FIG. 2. FIG. 2 shows a schematic cross section showing main arrangements associated with the ink remaining amount detecting module 20 and not a cross section obtained by cutting a particular area.

With reference to FIGS. 2, 3A, and 3B, description will be given of the structure associated with the ink remaining amount detecting module 20. A through-hole is formed in a surface of a bottom wall of the cup portion 2 which constitutes an outer surface of the ink tank 1 (see FIG. 1). The ink remaining amount detecting module 20 is fitted into this through-hole. The ink remaining amount detecting module 20 has a support substrate 21 and an information storage element 22 mounted on a first surface 21*b* of the support substrate 21. The information storage element 22 is a nonvolatile storage device to and from which information can be electrically, magnetically or electromagnetically written, deleted, and read. The information storage element 22 may be, for example, an EEPROM, a flash memory, or a magnetic memory.

A sealing structure 23 is provided on the first surface 21*b* of the support substrate 21 so as to cover the information storage element 22 to prevent it from directly contacting ink or gas. The sealing structure 23 is composed of a member transmitting light emitted by an optical sensor 52 (see FIGS. 5A and 5B) described later and is shaped like a triangular prism having two reflection planes that are not parallel each other on the first surface 21*b*. The sealing structure 23 has, as the two reflection planes, two slopes 23*a* and 23*b* starting at a top edge and inclined at 45° to the normal of the first surface 21*b* of the support substrate 21. In other words, the two slopes 23*a* and 23*b* are inclined at 45° to the first surface 21*b* of the support substrate 21 and cross at right angles at the top.

A plurality of external contact electrodes 24 are provided on a second surface 21*c* of the support substrate 21 which is opposite the first surface 21*b*. The plurality of external contact electrodes 24 are electrically connected to terminals of the information storage element 22 via respective wires.

Two through-holes 21*a* are formed in the support substrate 21 so as to penetrate through the first surface 21*b* and then the second surface 21*c*. The through-holes 21*a* are located on either side of the information storage element 22. Each through-hole 21*a* is also formed in such a fashion each axis of the through-hole 21*a* crosses the corresponding slopes 23*a* and 23*b* of the sealing structure 23. Each through-hole 21*a* is filled with a part of the sealing structure 23 so that the sealing structure 23 rises from the second surface 21*c* in dome form.

The sealing structure 23 such as the one described in the present embodiment can be formed, for example, as follows. First, the support substrate 21 is provided on which the information storage element 22 is mounted, and on which the external contact electrode 24 and wiring connecting between the information storage element 22 and the external contact electrode 24 are formed together, and on which two through-holes 21*a* are formed moreover. Then, a potting frame is installed on the first surface 21*b* of the support substrate 2 so as to cover the information storage element 22 and two through-holes 21*a* in the support substrate 21. The potting frame has an inner surface the shape of which is the same as the external shape of the sealing structure 23 intended to form on the first surface 21*b* of the support substrate 21. The potting frame is formed of a material that transmits ultraviolet rays. Then, an ultraviolet-curing potting resin is filled in the frame. In this state, the potting resin is cured by irradiating it with ultraviolet rays via the frame. Finally, the frame is removed. Thus, the sealing structure 23 can be obtained which is shaped like a triangular prism on the first surface 21*b* and which is filled in the two through-holes 21*a* so as to rise from the second surface 21*c* like a dome.

The sealing structure 23 need not necessarily be filled into the through-holes 21*a* provided that the predetermined shape is formed on the first surface 21*b* of the support substrate 21. The sealing structure 23 not filled into the through-holes 21*a* can be obtained by for example, forming the sealing structure 23 on the first surface 21*b* of the support substrate 21 and then forming through-holes 21*a*. Here, the "predetermined shape" on the first surface 21*b* of the support substrate 21 has a plurality of slopes inclining from the first surface 21*b* so that light incident through one of the two through-holes 21*a* can be reflected by the slopes and then emitted through the other through-hole 21*a*.

The ink remaining amount detecting module 20 configured as described above is fixed to the through-hole in the cup portion 2 so that the first surface 21*b* of the support substrate 21 faces the ink accommodating chamber 6, that is, the sealing structure 23 faces the interior of the ink accommodating chamber 6. This installation of the ink remaining amount detecting module 20 allows the second surface 21*c* of the support substrate 21 to be exposed to the outer surface of the ink tank 1 and enables light to travel between the interior and exterior of the ink tank 1 through the through-holes 21*a* in the support substrate 21. Further, since the second surface 21*c* of the support substrate 21 is exposed to the outer surface of the ink tank 1, the external contact electrode 24 is exposed to the outer surface of the ink tank 1. An adhesive 25 is filled into the gap between the ink remaining amount detecting module 20 and the cup portion 2 to prevent ink from leaking from the ink accommodating chamber 6.

Figure 4:
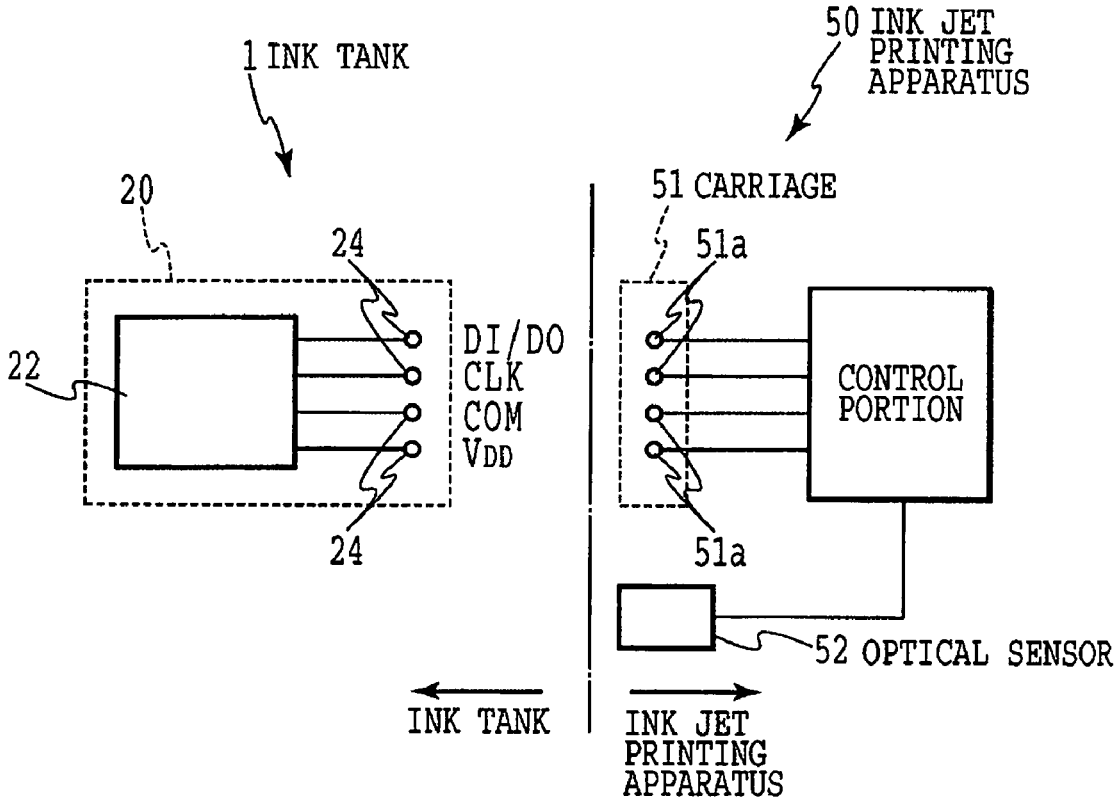
FIG. 4 is a diagram showing the electrical configuration of the ink remaining amount detecting module according to the embodiment shown in FIG. 1.

FIG. 4 shows the electrical configuration of the ink remaining amount detecting module 20. In the ink tank 1, the external contact electrodes 24 of the ink remaining amount detecting module 20, which are connected to the information storage element 22, are, for example, a terminal DI/DO for data I/O, a power terminal Vdd for driving the information storage element 22, a common terminal COM for grounding, and a clock terminal CLK. On the other hand, an ink jet printing apparatus 50 has a carriage 51 that detachably holds the ink tank 1. The ink tank 1 is installed on the carriage 51. An ink jet print head (not shown) that ejects ink is integrally or detachably mounted on the carriage 51. A print medium such as paper or a resin sheet is printed by supplying the ink jet print head with ink from the ink tank 1 and ejecting the supplied ink from the ink jet print head.

Contact terminals 51*a* are provided on the carriage 51 so that, when the ink tank 1 is installed, the contact terminals 51*a* are electrically connected to the respective external contact electrodes 24. Further, the ink jet printing apparatus 50 is provided with the optical sensor 52. The optical sensor 52 may be provided on the carriage 51, on which the ink tank 1 is installed, or on another member. The optical sensor 52 irradiates the ink remaining amount detecting module 20 with light and detects return light to obtain an analog signal corresponding to the intensity of the return light. The analog signal is transmitted to a control portion of the ink jet printing apparatus 50. The analog signal is then converted into a digital signal indicating information on the amount of ink remaining in the ink tank 1. The digital signal is then transmitted to the information storage element 22 of the ink remaining amount detecting module 20 via the contact terminals 51*a*. The signal is then stored in the information storage element 22 as information on the ink remaining amount. Further, the information on the ink remaining amount stored in the information storage element 22 is transmitted to the control portion of the ink jet printing apparatus via the contact terminals 51*a*.

Figure 5A:
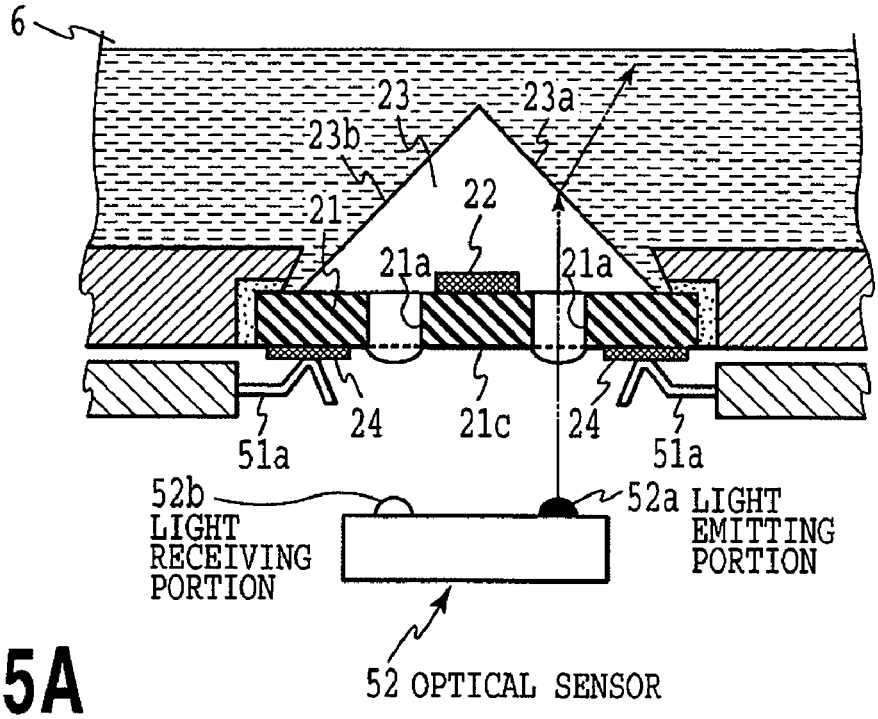
Figure 5B:
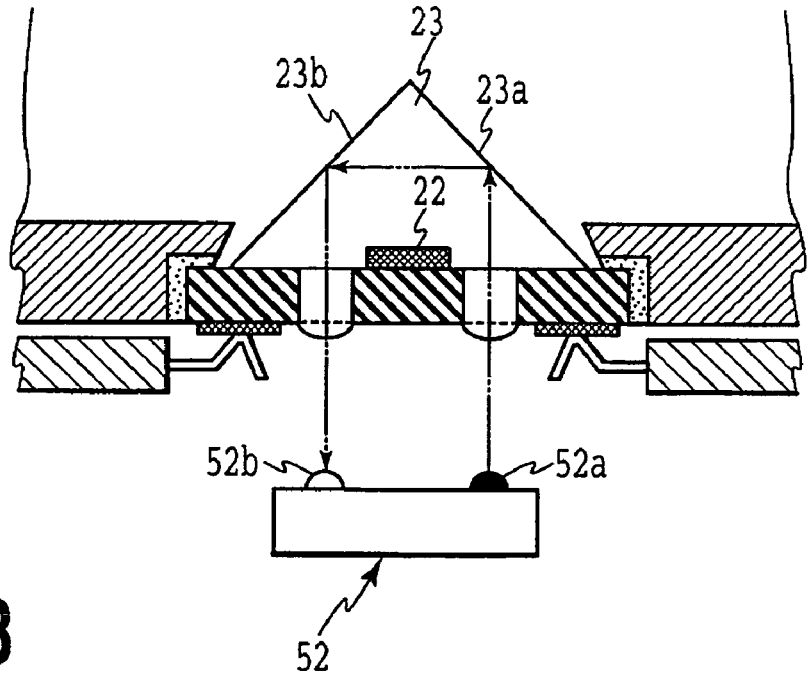

When the ink tank is installed on the carriage 51, the contact terminals 51*a* come into contact with the respective external contact electrodes 24 for electric connection. To appropriately contact the contact terminals 51*a* to the respective external contact electrodes 24 when the ink tank is installed on the carriage 51, the contact terminals 51*a* are preferably composed of leaf springs consisting of conductive members, for example, as shown in FIGS. 5A and 5B. The contact terminals 51*a* shown in FIGS. 5A and 5B show an example of the structure of a connection with the ink tank 1. The shape or arrangement of the contact terminals 51*a* may be appropriately changed.

Reference will be made of FIGS. 5A and 5B. The optical sensor 52 has a light emitting portion 52*a* that emits light and a light receiving portion 52*b* that receives light. The optical sensor 52 is placed so as to lie opposite the ink remaining amount detecting module 20 at least when the ink remaining amount is detected. For example, the optical sensor 52 is placed so as to lie opposite the ink remaining amount detecting module 20 if it is mounted on the carriage or to lie opposite the ink remaining amount detecting module 20 when the carriage is at a predetermined position if it is mounted on a member different from the carriage. In particular, at this ink remaining amount detecting position, the light emitting portion 52*a* lies opposite one of the two through-holes 21*a*, while the light receiving portion 52*b* lies opposite the other through-hole 21*a*. Further, the optical sensor 52 is placed so that the central optical axis of a luminous flux emitted by the light emitting portion 52*a* is perpendicular to the first surface 21*b* of the support substrate 21.

The wavelength of light emitted by the light emitting portion 52*a* is not particularly limited. However, light desirably has such a wavelength as hinders the light from being attenuated by the sealing structure 23. For example, if an epoxy-based potting resin is used as the sealing structure 23, infrared rays are preferably used as light emitted by the light emitting portion 52*a*. Further, to allow light from the light emitting portion 52*a* to be efficiently utilized, the light emitting portion 52*a* preferably emits condensed light. Moreover, if the material constituting the sealing structure 23 is filled into the through-holes 21*a* as in the case of the present embodiment, condensing effect is more improved as the material rises from the second surface 21*c* of the support substrate 21 in dome form.

With reference to FIGS. 5A and 5B again, description will be given of detection of the ink remaining amount according to the present embodiment. The light emitted by the light emitting portion 52*a* of the optical sensor 52 passes through one of the through-holes 21*a* of the support substrate 21. The light is incident on the sealing structure 23 and then travels through the sealing structure 23 to one of the slopes 23*a*.

If there is enough ink in the ink accommodating chamber 6, that is, the level of the ink is higher than the position at which light emitted by the light emitting portion 52*a* reaches the slope 23*a*, then the light is transmitted through the sealing structure 23 as shown in FIG. 5A. Thus, the light from the light emitting portion 52*a* does not return to the light receiving portion 52*b*. Consequently, the light is not detected by the light receiving portion 52*b*. Therefore, the optical sensor 52 does not provide any output and the control portion (see FIG. 4) of the ink jet printing apparatus 50 determines the presence of ink. On the basis of the determination, the control portion writes the information indicating the presence of ink to the information storage element 22 of the ink remaining amount detecting module 20 through the predetermined contact terminal 51*a* (terminal DI/DO shown in FIG. 4).

If the ink in the ink accommodating chamber 6 is consumed, so that the level of the ink in the ink accommodating chamber 6 is lower than the position at which light emitted by the light emitting portion 52*a* reaches the slope 23*a*, the light emitted by the light emitting portion 52*a* is reflected by the two slopes 23*a* and 23*b* while traveling through the sealing structure 23. The light passes through the other through-hole 21*a* and then enters the light receiving portion 52*b*. Thus, the optical sensor 52 provides an analog signal corresponding to the intensity of the light incident on the light receiving portion 52*b*. The analog signal is transmitted to a control portion of the ink jet printing apparatus 50. The control portion then determines the absence of ink. On the basis of the determination, the control portion updates, through the predetermined contact terminal 51*a* (terminal DI/DO shown in FIG. 4), the information stored in the information storage element 22 to information indicating the absence of ink. The data may be updated by rewriting data written to the information storage element 22 and indicating the presence of ink or by additionally writing the data indicating the absence of ink, to another storage area in the information storage element 22 while leaving the data indicating the presence of ink as it is. At the same time, the control portion warns the user through the ink jet printing apparatus 50 that the ink has been exhausted. The control portion thus urges the user to exchange the ink tank with a new one and suspends a printing operation as required.

Description has been given of the optical detection of the ink remaining amount utilizing the reflection and transmission of light traveling through the optical prism. The principle of this optical detection is well known, and thus its detailed description is omitted.

As described above, according to the present embodiment, the ink remaining amount detecting module 20 has the information storage element 22. It is thus possible to write the information on the ink remaining amount detected by the optical sensor to the information storage element 22. As a result, the information on the amount of ink remaining in the ink tank can be simply and reliably obtained by utilizing the external contact electrodes 24 used to write the information on the ink remaining amount to read the data stored in the information storage element 22. Furthermore, the information storage element 22 is mounted on the surface of the support substrate 21 which faces the ink accommodating chamber 6, and thereby the information storage element 22 is protected by the support substrate 21, and thus prevented from being damaged. Further, the external contact electrodes 24 are provided on the surface of the support substrate 21 which is opposite the one on which the information storage element 22 is mounted. The external contact electrodes 24 are thus exposed to the outer surface of the ink tank 1. Therefore, information can be easily written to the information storage element 22.

The information storage element 22 is installed so as to face the ink accommodating chamber 6. Accordingly, the information storage element 22 must be sealed so as not to come into direct contact with the ink. Thus, the sealing structure 23, which seals the information storage element 22, is composed of the light transmissive member. This allows the sealing structure 23 to be also used as an optical prism to optically detect the ink remaining amount. As a result, it is unnecessary to provide an optical prism used to detect the ink remaining amount, independently of the support substrate 21, on which the information storage element 22 is mounted. This enables downsizing the ink remaining amount detecting module 20. Therefore, the ink remaining amount detecting module 20 can be mounted even in the small-sized ink tank 1 without impairing its compactness. The ink remaining amount detecting module 20 is thus also suitable for the small-sized ink jet printing apparatus 50.

The information on the ink remaining amount need not be precise. The information may be such information as indicates only the presence or absence of ink and contain a relatively small amount of data. The information storage element 22 may be a small-sized chip-like element utilizing a semiconductor. Consequently, the mounting of the information storage element 22 does not hinder the ink remaining amount detecting module 20 from downsizing. The information storage element 22 is not limited to a one-chip configuration but may have a hybrid configuration. Further, the information storage element 22 is not limited to one that enables information to be rewritten by deleting and writing information. Of course, the information storage element 22 may enable information to be additionally written in an area different from a recorded area, that is, enable at least writing and reading.

In the above description, the information handled by the ink remaining amount detecting module 20 indicates the presence or absence of ink. However, strictly speaking, light emitted by the light emitting portion 52*a* has a certain spread, so that the intensity of light incident on the light receiving portion 52*b* varies in an analog manner at the boundary portion between a state in which the ink is determined to be present and a state in which the ink is determined to be absent. Thus, by using the optical sensor 52 comprising the light emitting portion 52*b* with a high detection accuracy, it is possible to detect not only the presence or absence of ink but also that the amount of ink remaining in the ink accommodating chamber 6 is small.

The information storage element 22 can also store information different from that on the ink remaining amount. Other information that can be stored in the information storage element 22 includes inherent information in the ink tank 1, such as product number, accommodated ink type, color, manufacture date, lot number or the like. This information are preliminarily written to the information storage element 22 when the ink tank 1 is manufactured.

The control portion of the ink jet printing apparatus 50 loads the information written to the information storage element 22 when the ink tank 1 is installed. In the ink jet printing apparatus 50, data to be compared with the information written to the information storage element 22 are stored. The ink jet printing apparatus 50 compares the stored data with the data in the ink tank 1 to determine whether or not the installed ink tank 1 is compatible with the ink jet printing apparatus 50, whether or not the ink tank 1 has been installed at the correct position. The ink jet printing apparatus 50 can then give warning to the user as required.

After the ink has been exhausted, the ink tank 1 may be filled with new ink and then reused. If the ink tank 1 filled with new ink is installed in the ink jet printing apparatus 50 for reuse, the information storage element 22 of the ink remaining amount detecting module 20 contains ink remaining amount information indicating the absence of ink. Accordingly, when the ink tank 1 is installed in the ink jet printing apparatus 50 for reuse, the ink remaining amount information obtained from the optical sensor 52 is inconsistent with the ink remaining amount information obtained from the information storage element 22.

Thus, in this case, to avoid this inconsistency, the control portion of the ink jet printing apparatus 50 preferentially uses the information obtained from the optical sensor 52 to rewrite the ink remaining amount information in the information storage element 22. Alternatively, regardless of whether the ink tank 1 is reused or a new ink tank 1 is manufactured, during a manufacturing process of the ink tank 1, the housing 4 (see FIG. 1) not filled with any ink is provided and filled with ink. Then, information indicating the presence of ink is written to the information storage element 22 as ink remaining amount information. The writing information referred here involves not only the newly writing information but also the update of already written information. For example, in the ink tank 1 for reuse, the information indicating the absence of ink has already been written to the information storage element 22. Accordingly, in this case, the information indicating the absence of ink may be changed to the information indicating the presence of information, or the information indicating the presence of information may be additionally written in a different area in the information storage element 22. Ink is filled into the ink tank 1 held in the use position so as to come into contact at least with the sealing structure and reach the ink supply port after the contact.

This avoids the inconsistency between the information obtained from the optical sensor 52 and the information obtained from the information storage element 22 even when the ink tank 1 for reuse is installed in the ink jet printing apparatus 50. Further, if it is not evident whether the ink tank 1 is new or used, the presence or absence of ink in the ink tank 1 can be simply and reliably checked by reading the information stored in the information storage element 22.

The presently most prevailing ink jet printing apparatus as an example of the ink jet printing apparatus 50 can output full color images using a plurality of color inks. Thus, a plurality of ink tanks 1 accommodating different color inks are installed in the ink jet printing apparatus 50. In many cases, the ink tanks 1 accommodating different color inks are housed in a common housing member. The ink tanks 1 accommodating different color inks are installed at predetermined positions. In this case, it is desirable to write not only the ink remaining amount information but also information on the ink color to the information storage element 22. Then, the control portion of the ink jet printing apparatus 50 also reads information on the ink color written to the information storage element 22 to determine whether or not that ink tank 1 is installed at the predetermined position. This makes it possible to detect that the user has erroneously installed the ink tank 1.

If the ink tank 1 for color printing is to be reused, information on the ink color has already been written to the information storage element 22 of ink tank 1 used. Accordingly, before the ink tank 1 is filled with ink, information on the ink color written to the information storage element 22 is read. Then, the ink tank 1 may be filled with ink of the same color as that indicated in the information. This eliminates the need to rewrite the ink color information written to the information storage element 22. The ink tank may be filled with ink of a color different from that indicated in the information. However, in this case, the ink color information written to the information storage element 22 is rewritten in accordance with the color of the ink to be filled or the ink that has been filled. Further, if the ink tank 1 is to be reused, the interior of the ink accommodating chamber is desirably washed before the ink is filled into the ink tank. If the ink tank 1 is intended for color printing and is to accommodate ink of a color different from that of the previous ink, washing the ink accommodating chamber is particularly preferable in preventing the mixture of ink colors because a small amount of ink may be left in the ink accommodating chamber. However, even if the ink tank 1 is to accommodate ink of the same color as that of the previous ink, or the ink tank 1 is intended for monochromatic printing and the information storage element 22 contains no ink color information, it is effective to wash the ink accommodating chamber because a small amount of ink remaining in the ink accommodating chamber may be deteriorated over time.

Figure 6A:
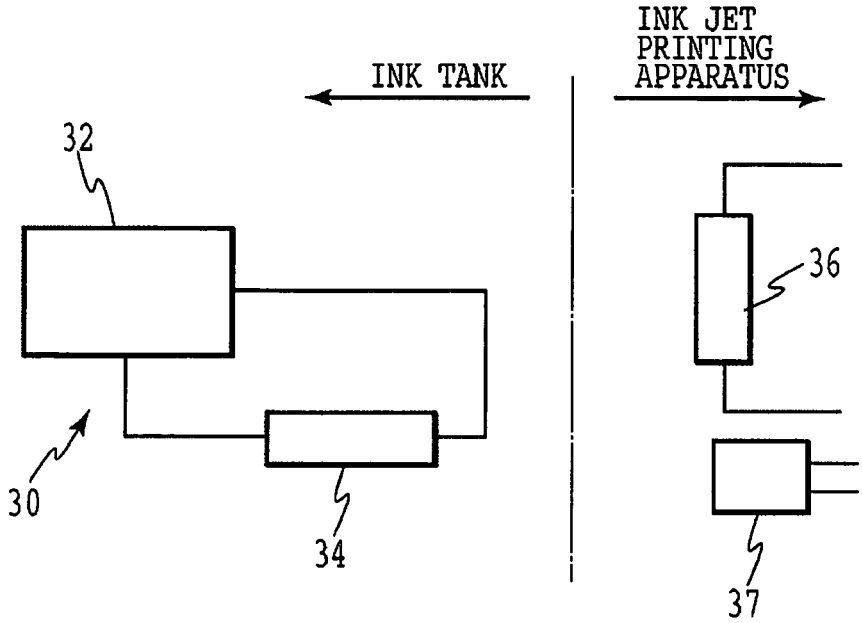
Figure 6B:
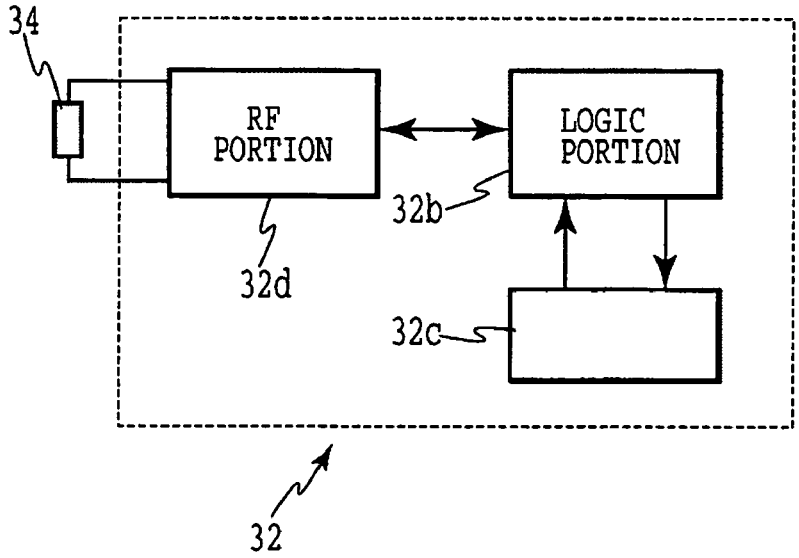

In the above example, the physical contact between the electrodes is used to transmit information between the ink tank 1 and the ink jet printing apparatus 50. However, a non-contact transmission may be carried out. FIGS. 6A and 6B show an example.

An ink remaining amount detecting module 30 shown in FIGS. 6A and 6B is based on a system called RF-ID (Radio Frequency Identification) and utilizes high-frequency electric waves of the order of several GHz, which are called microwaves, to transmit information in a non-contact manner. The ink remaining amount detecting module 30 has an information storage element 32 sealed by a sealing structure (not shown) which is formed by a light transmissive member and which has a triangular prism shape, and an antenna portion 34 used to transmit information between the information storage element 32 and the ink jet printing apparatus. The information storage element 32 and the antenna portion 34 are provided on a support substrate (not shown). The information storage element 32 is provided on one side surface of the support substrate so as not to be exposed to the exterior of the ink tank. The antenna portion 34 is provided on a surface opposite to the information storage element 32 in order to maximally prevent the high-frequency energy of electric waves to be received from being absorbed by the ink in the ink tank. On the other hand, the ink jet printing apparatus is provided with an antenna portion 36 used to transmit and receive information to and from the ink remaining amount detecting module 30 and an optical sensor 37 used to optically detect the amount of ink remaining in the ink tank.

As shown in FIG. 6B, the information storage element 32 has a memory region 32*c* in which ink remaining amount information or both ink remaining amount information and information inherent in the ink tank are stored, an RF portion (high-frequency processing section) 32*d* that converts an RF signal into a digital signal or a digital signal into an RF signal, and a logic portion 32*b* which converts a digital signal into a data on the ink remaining amount, the digital signal having been transmitted by the ink jet printing apparatus via the antenna portion 34 and converted by the RF portion, the logic portion 32*b* writing the converted ink remaining amount data in the memory region 32*c*, transmitting the converted ink remaining amount data to the RF portion 32*d*, or controlling the transmission of signals between the memory region 32*c* and the RF portion 32*d*.

Thus, the non-contact transmission of information eliminates the need for the contact structure used to transmit information between the ink remaining amount detecting module 30 and the ink jet printing apparatus. This can provide a simpler and more compact configuration and significantly improves the degree of freedom in selecting the position at which the ink remaining amount detecting module 30 is mounted.

In the above example, the information storage element using the RF-ID utilizing high-frequency electric wave of the order of GHz has been explained. In the present invention, use of electromagnetic induction coupling RF-ID utilizing high-frequency electromagnetic induction, which is slightly inferior in size to the RF-ID utilizing high-frequency electric wave, will of course produce remarkable advantageous result that the information storage element integrated with the ink remaining amount detecting module can produce. In the case where the electromagnetic induction coupling RF-ID is employed, a loop coil antenna is common for the antenna portion.

Now, with reference to FIGS. 7A to 7C, description will be given of another example of the structure of the ink remaining amount detecting module according to the present invention.

Figure 7A:
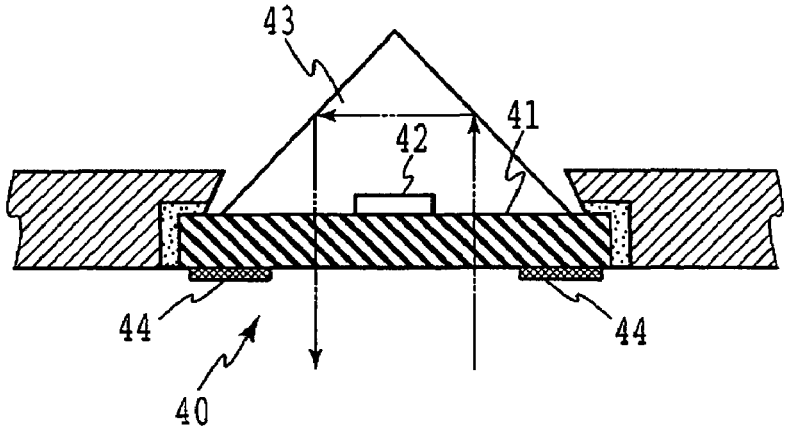

In an ink remaining amount detecting module 40 shown in FIG. 7A, a support substrate 41 is composed of a material transmitting light emitted by an optical sensor (not shown). A material suitable for the support substrate 41 transmitting light is a transparent resin, a glass material, or the like. That is, by using the support substrate 41 transmitting light eliminates, there is not any need to form in the support substrate 41 a through-hole through which light is incident on a sealing structure 43.

Screen printing, etching, copper foiling, or the like can be used to form external contact electrodes 44 or the wires connecting the information storage element 42 with the external contact electrodes 44 on the support substrate 41. A material constituting the support substrate 41 is not particularly limited provided that it can transmit light from the optical sensor. An appropriate material can be properly selected taking into account the productivity of the support substrate 41, the easiness with which the external contact electrodes or wires can be formed, adhesion to an ink tank, and the like.

If the support substrate 41 is composed of a light transmitting material, external unintended light is likely to be incident on the sealing structure 43. When the unintended light is incident on the sealing structure 43, it may become stray light to cause the ink remaining amount to be erroneously detected. Thus, a light blocking mask (not shown) is desirably formed on a part of one or both of the surfaces of the support substrate 41 to prevent unwanted light from entering the sealing structure 43. For example, during the formation of the external contact electrodes 44 or wires, the light blocking mask can be formed as a dummy pattern together with a pattern for the external contact electrodes 44 or wires.

Figure 7B:
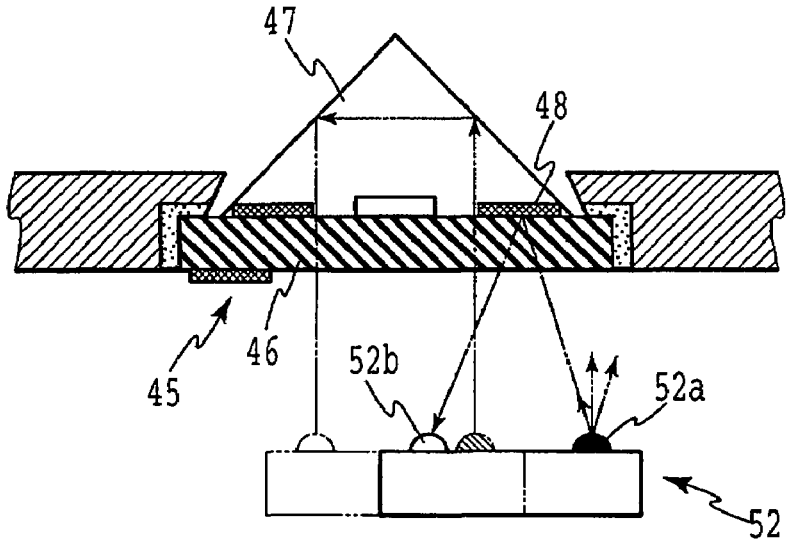

In the example shown in FIG. 7B, the above light blocking mask is utilized to enable the detection of not only the presence or absence of ink but also the presence or absence of an ink tank. In FIG. 7B, an ink remaining amount detecting module 45 has a light blocking mask 48 as a reflector formed on a part of one surface of a support substrate 46 of the ink remaining amount detecting module 45. The light blocking mask 48 is formed of a material that reflects light emitted by a light emitting portion 52*a* of an optical sensor 52 provided in the ink jet printing apparatus.

The optical sensor 52 is movable between a first position shown by a solid line and a second position shown by a dashed line relative to the ink tank. At the first position, light emitted by the light emitting portion 52*a* is reflected by the light blocking mask 48 and can return to the light receiving portion 52*b* when an ink tank has been installed. If at the first position, the light receiving portion 52*b* cannot detect light emitted by the light emitting portion 52*a*, this means that there has been no reflection from the light blocking mask 48. This makes it possible to detect that no ink tank has been installed.

At the second position, the ink remaining amount is detected. At this position, as previously described, the presence or absence of ink can be detected depending on whether or not light emitted by the light emitting portion 52*a* and entering the sealing structure 47 returns to the light receiving portion 52*b*.

With the conventional simple optical detection system, even if no ink tank has been installed, the detected result is the same as that obtained if an amount of ink is present. Accordingly, to detect the presence or absence of an ink tank, a sensor for detecting the presence or absence of an ink tank must be provided separately from the sensor for detecting the ink remaining amount. In contrast, according to the present example, the absence of an ink tank can be distinguished from the presence of ink without providing the two types of sensors.

As is apparent from FIG. 7B, the direction in which the light emitting portion 52*a* emits light utilized to detect the presence or absence of an ink tank differs from the direction in which the light emitting portion 52*a* emits light utilized to detect the presence or absence of the ink remaining amount. However, the light emitted by the light emitting portion 52*a* includes directional components that cannot be condensed. Accordingly, the use of the uncondensed light enables light from the light emitting portion 52*a* to be reflected by the light blocking mask 48 and received by the light receiving portion 52*b*.

In the example shown in FIG. 7B, the light blocking mask 48 is formed on the surface (first surface) of the support substrate 46 on which the sealing structure 47 is provided. However, the light blocking mask 48 maybe formed on the opposite surface (second surface), on which the optical sensor 52 is placed. Further, in the example shown in FIG. 7B, the support substrate 46 consists of a light transmitting material. However, even if the support substrate 46 consists of a light non-transmissive member and instead has two through-holes through which light passes, similar effects are exerted by forming a reflector on the second surface.

Figure 7C:
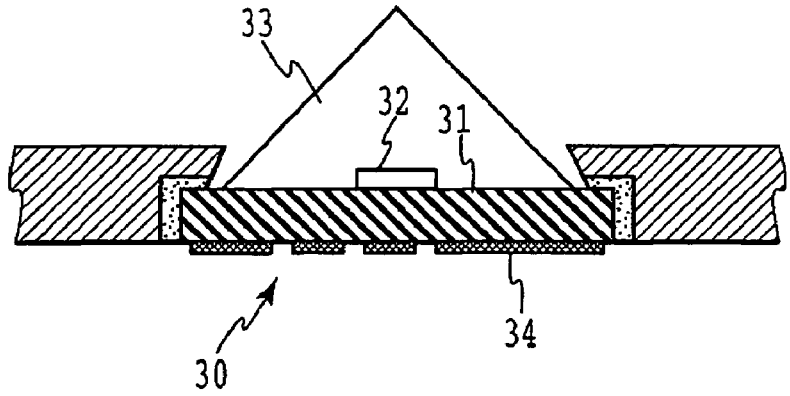

FIG. 7C shows an example of the structure of the ink remaining amount detecting module 30 that transmits and receives information to and from the ink jet printing apparatus in a non-contact manner as shown in FIGS. 6A and 6B. The antenna portion 34 is provided on the surface of the support substrate 31 which is opposite the one on which the information storage element 32 is mounted. Since the antenna portion 34 is used to transmit and receive information to and from the ink jet printing apparatus in a non-contact manner, no external contact. electrodes are required. In this example, the support substrate 31 is also formed of a material transmitting light from the optical sensor (not shown). Thus, the support substrate 31 does not require any through-holes through which light from the optical sensor is incident on the sealing structure 33.

Of course, in the example shown in FIG. 7C, a light blocking mask and a reflector may also be formed on a part of the support substrate 31. The light blocking mask is used to prevent erroneous detection resulting from stray light and the reflector is used to detect the presence or absence of an ink tank.

Figure 8:
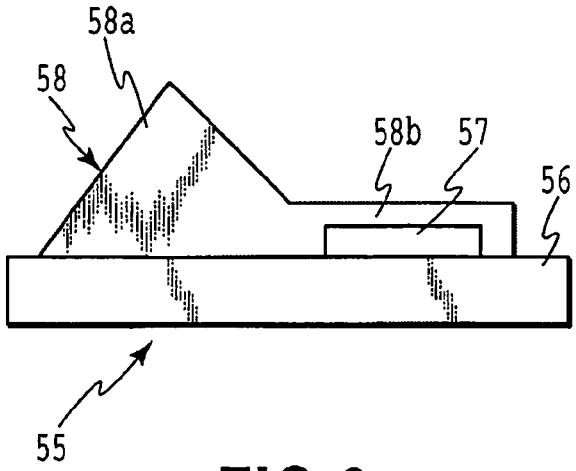
FIG. 8 is a diagram showing still another embodiment of the structure of the ink remaining amount detecting module according to the present invention.

In the description of the above example, the sealing structure as a whole is shaped like a prism. However, the shape of the sealing structure may be any shape provided that at least a part of the sealing structure which constitutes an optical path for ink remaining amount detecting light has a prism shape consisting of a light transmitting material. FIG. 8 shows an example. An ink remaining amount detecting module 55 shown in FIG. 8 has a support substrate 56, an information storage element 57 mounted on one surface of the support substrate 56, a sealing structure 58 provided on one surface of the support substrate 56 and sealing the information storage element 57, and information transmitting means (not shown) for transmitting ink remaining amount information between the information storage element 57 and an external device. The information transmitting means may use external contact electrodes or an antenna portion such as those described above.

The sealing structure 58 consists of a light transmitting member and is shaped to have a triangular prism portion 58*a* and a sealing portion 58*b* formed by extending one side of the foot of the prism portion 58*a*. The information storage element 57 is sealed by the sealing portion 58*b*. The support substrate 56 may consist of a light transmissive member or a light non-transmissive member. If the support substrate 56 consists of a light non-transmissive member, two through-holes (not shown) are formed in the area of the support substrate 56 in which the triangular prism portion 58*a* is provided so that ink remaining amount detecting light passes through the through-holes. If the support substrate 56 consists of a light transmissive member, the triangular prism portion 58*a* is irradiated with the ink remaining amount detecting light. In this manner, effects similar to those described in the above example are exerted even if the sealing structure 58 is divided into an ink remaining amount detecting portion and a portion sealing the information storage element 57.

In the example shown in FIG. 8, the sealing portion 58*b* of the sealing structure 58 need not be composed of a light transmissive member and then may be composed of a light non-transmissive member. Further, the triangular prism portion 58*a* may be integrated with or separated from the sealing portion 58*b*. In the present example, a light blocking mask or a reflector such as those described above may be provided on a part of the support substrate 56.

Now, description will be given of the form of an ink tank to which the present invention is applicable. In the above embodiment, the present invention is applied to the ink tank 1 having the negative pressure generating member housing chamber 5 and the ink accommodating chamber 6 as shown in FIG. 1. However, the present invention is not limited to this.

Figure 9:
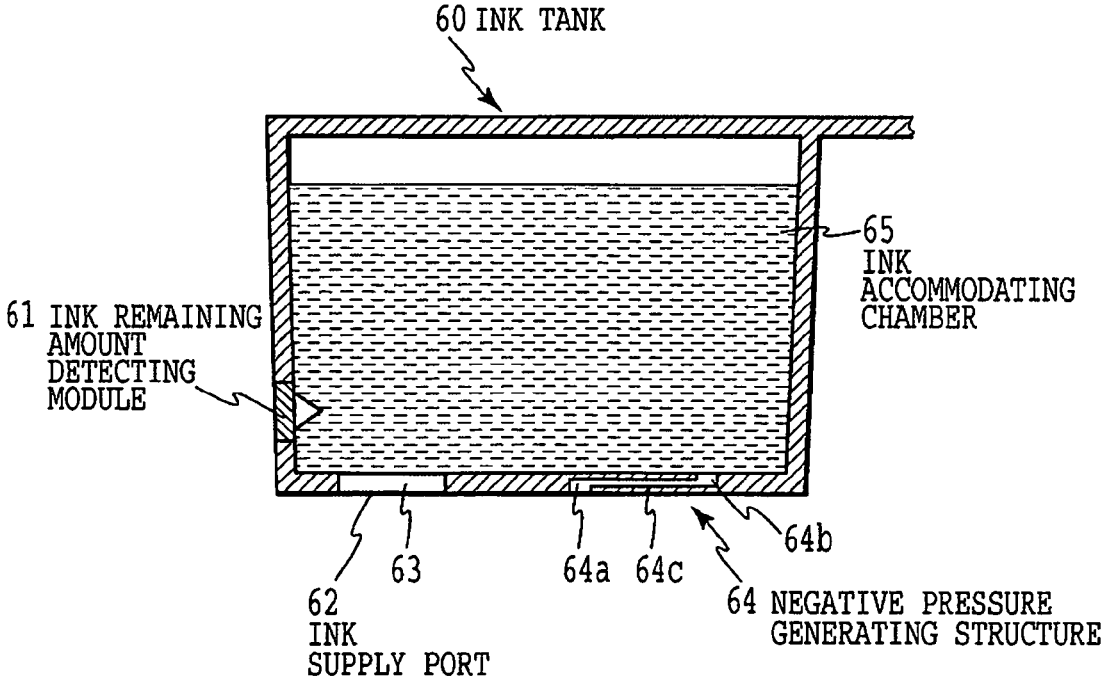
FIG. 9 is a sectional view of an embodiment in which the present invention is applied to another ink tank.

FIG. 9 shows a sectional view of another example of an ink tank to which the present invention is applied. In an ink tank 60 shown in FIG. 9, the interior of the housing as a whole constitutes an ink accommodating chamber 65 that directly accommodates ink. An ink supply port 62 is formed in a bottom wall of the ink tank 60 so that accommodated ink can be supplied to a print head (not shown) through the ink supply port 62. An elastic valve membrane 63 is provided in the ink supply port 62. The elastic valve membrane 63 is opened only when an ink lead-out pipe (not shown) is inserted into the ink supply port during the installation of the ink tank 60 in the ink jet printing apparatus (not shown). This prevents the leakage of ink from the ink tank 60 when the ink tank 60 has not been installed in the ink jet printing apparatus.

Further, a negative pressure generating structure 64 is formed in the bottom wall of the ink tank 60 to generate a negative pressure in an ink accommodating chamber 65. The negative pressure generating structure 64 has a first concave portion 64*a* having a concave shape with respect to the outer surface of the ink tank 60, a second concave portion 64*b* having a concave shape with respect to the inner surface of the ink tank 60, and a connecting passage 64*c* which connects the concave portions 64*a* and 64*b* and which constitutes for example a serpentine passage. The ink tank 60 has an internal pressure lower than its external pressure. Ink is held in the ink accommodating chamber 6 so as to form meniscus in the second concave portion 64*b*. As the internal pressure decreases in connection with the consumption of the ink, air is correspondingly introduced into the ink accommodating chamber 65 through the connecting passage 64*c*.

An ink remaining amount detecting module 61 is mounted on a side wall of the ink tank 60. The ink remaining amount detecting module 61 may have any of the above forms. The ink remaining amount detecting module 61 is mounted so that a sealing structure contacts the ink in the ink accommodating chamber 65. The sealing structure is formed of a light transmissive member, seals the information storage element (not shown) and also functions as an optical prism. Since it is possible to properly set the mounting position of the ink remaining amount detecting module 61 in a height direction in connection with the use position of the ink tank 60, an ink level at which the absence of ink is to be detected can be arbitrarily set by thus mounting the ink remaining amount detecting module 61 on the side wall of the ink tank 60.

To reliably exert the effects of the present invention, it is important not only to place the sealing structure at a position corresponding to an ink remaining amount. to be sensed but also to fill ink into the ink tank so that the ink contacts at least the sealing structure while accommodating the ink so that after the filling, the ink reaches the neighborhood of the ink supply portion. This also applies to the reuse of a used ink tank after refilling.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An ink tank having an ink accommodating chamber in which ink is accommodated, and an ink supply port through which the ink in the ink accommodating chamber is supplied to a print head, the ink tank comprising:

an ink remaining amount detecting module including;

a support substrate having a site which transmits light;

nonvolatile information storage means provided on the support substrate and to and from which information can be written and read;

a sealing structure provided on the support substrate so as to cover the information storage means and the site transmitting light, the sealing structure transmitting light and being shaped like a prism; and information transmitting means provided on the support substrate to receive external information on the ink remaining amount, write the information to the information storage means, and transmit the information written to the information storage means, to an external device;

a housing member constituting an outer wall of the ink accommodating chamber and the ink supply port;

wherein the ink remaining amount detecting module is mounted in the housing member so that the sealing structure provided on the support substrate is exposed to the ink accommodating chamber and that another surface on the support substrate is exposed to an outer surface of the housing member.

2. The ink tank as claimed in claim 1 wherein the ink is accommodated so that the ink contacts the sealing structure and that the ink having contacted the sealing structure reaches the ink supply port.

3. The ink tank as claimed in claim 1 wherein an opening is formed in the housing member, and the ink remaining amount detecting module is fixedly fitted into the opening in the housing member.

4. An ink jet printing apparatus in which the ink tank as claimed in claim 1 detachably installed and which prints a print medium using a print head which ejects ink fed from the ink tank, the ink jet printing apparatus comprising:

a holding portion which detachably holds the ink tank;

an optical sensor which emits light to the ink remaining amount detecting module of the ink tank held in the holding portion; and information transmitting means of the apparatus for transmitting and receiving information to and from the ink remaining amount detecting module via the information transmitting means of the ink remaining amount detecting module mounted in the ink tank.

5. The ink jet printing apparatus as claimed in claim 4 wherein a reflector reflecting light is formed on a part of the support substrate of the ink remaining amount module, and the optical sensor moves, relative to the ink tank, between a first position at which light emitted by the optical sensor is reflected by the reflector and a second position at which the light is incident on the sealing structure of the ink remaining amount detecting module.

6. A method for manufacturing an ink tank having an ink accommodating chamber in which ink is accommodated, and an ink supply port through which the ink in the ink accommodating chamber is supplied to a print head, the method comprising the steps of:

providing a housing member constituting an outer wall of the ink accommodating chamber and the ink supply port and mounting an ink remaining amount detecting module so that a sealing structure of the module is exposed to the ink accommodating chamber, the ink remaining amount detecting module including;

a support substrate having a site which transmits light;

nonvolatile information storage means provided on the support substrate and to and from which information can be written and read;

a sealing structure provided on the support substrate so as to cover the information storage means and the site transmitting light, the sealing structure transmitting light and being shaped like a prism; and information transmitting means provided on the support substrate to receive external information on the ink remaining amount, write the information to the information storage means, and transmit the information written to the information storage means to an external device;

filling ink into the ink accommodating chamber; and writing information indicating presence of ink, to the information storage means of the ink remaining amount detecting module.

7. The method for manufacturing an ink tank as claimed in claim 6 wherein the step of filling ink into the ink accommodating chamber includes filling the ink so that the ink contacts at least the sealing structure and that the ink having contacted the sealing structure reaches the ink supply port.

8. The method for manufacturing an ink tank as claimed in claim 6 wherein information indicating absence of ink is pre-written to the information storage means, and the step of writing information indicating the presence of ink, to the information storage means includes updating the information pre-written to the information storage means.

9. The method for manufacturing an ink tank as claimed in claim 6 further comprising a step of writing information on a color of the ink to the information storage means of the ink remaining amount detecting module.

10. The method for manufacturing an ink tank as claimed in claim 6 wherein the information on the color of the ink is pre-written to the information storage means of the ink remaining amount detecting module, and the step of filling ink into the ink accommodating chamber includes filling ink of the sane color as that indicated in the information on the color of the ink pre-written to the information storage means.

11. The method for manufacturing an ink tank as claimed in claim 6 wherein the information on the color of the ink is pre-written to the information storage means of the ink remaining amount detecting module, and the step of filling the ink into the ink accommodating chamber includes filling ink of a color different from that indicated in the information on the color of the ink pre-written to the information storage means, and further comprising a step of updating the information on the color of the ink pre-written to the information storage means.

12. The method for manufacturing an ink tank as claimed in claim 6 further comprising a step of washing the interior of the ink accommodating chamber before the step of filling ink into the ink accommodating chamber.

* * * * *